United States Patent [19]

Cronin

[11] Patent Number: 4,704,192

[45] Date of Patent: Nov. 3, 1987

[54] PRESS APPARATUS FOR PRESSING A MOVING WEB

[75] Inventor: Dennis C. Cronin, Rockton, Ill.

[73] Assignee: Beloit Corp., Beloit, Wis.

[21] Appl. No.: 24,184

[22] Filed: Mar. 10, 1987

Related U.S. Application Data

[63] Continuation-in-part of Ser. No. 878,283, Apr. 29, 1986.

[30] Foreign Application Priority Data

Apr. 29, 1986 [WO] PCT Int'l Appl. ..... PCT/US86/00961

[51] Int. Cl.[4] ..... D21F 3/04

[52] U.S. Cl. ..... 162/360.1; 162/306; 162/358; 162/359

[58] Field of Search ..... 162/360.1, 305, 306, 162/205, 307, 359, 358

[56] References Cited

U.S. PATENT DOCUMENTS

| | | | |
|---|---|---|---|
| 2,415,351 | 2/1947 | Hornbostel | 162/206 |
| 3,023,805 | 3/1962 | Walker | 162/306 |
| 3,268,390 | 8/1966 | Ely, Sr. | 162/360.1 |
| 4,059,482 | 11/1977 | Kankaarpaa et al. | 162/360.1 |
| 4,086,131 | 4/1978 | Rempel et al. | 162/360.1 |
| 4,102,737 | 7/1978 | Morton | 162/307 |
| 4,157,938 | 6/1979 | Clemens et al. | 162/307 |
| 4,201,624 | 5/1980 | Mohr et al. | 162/360.1 |
| 4,219,383 | 8/1980 | Valkama | 162/360.1 |
| 4,287,021 | 9/1981 | Justus et al. | 162/358 |
| 4,483,745 | 11/1984 | Wicks et al. | 162/360.1 |
| 4,561,939 | 12/1985 | Justus | 162/360.1 |
| 4,586,984 | 5/1986 | Laapotti | 162/360.1 |
| 4,648,942 | 3/1987 | Wanke et al. | 162/359 |

OTHER PUBLICATIONS

Paper Machine Felts and Fabrics, Albany Int. Corp., 1976, p. 109.

*Primary Examiner*—S. Leon Bashore
*Assistant Examiner*—K. M. Hastings
*Attorney, Agent, or Firm*—Dirk J. Venenan; Raymond W. Campbell; David J. Archer

[57] ABSTRACT

A press apparatus is disclosed for pressing a moving web formed on a forming wire. The apparatus includes a frame and a first plurality of rolls rotatably secured to the frame. A first continuous felt extends around the first plurality of rolls which include a pickup roll disposed adjacent to the wire for transferring the web from the wire onto the first felt. The first plurality of rolls also includes a first press roll which is disposed downstream relative to the pickup roll. A second continuous felt extends around a second plurality of rolls with the second felt cooperating with the first felt. The second plurality of rolls includes a second press roll which cooperates with the first press roll for defining therebetween a first nip. The web is urged against the second felt when the web emerges from the first nip and the second felt and supported web pass through a second nip defined by an extended nip press disposed downstream relative to the first nip.

7 Claims, 4 Drawing Figures

PRESS APPARATUS FOR PRESSING A MOVING WEB

CROSS REFERENCE TO RELATED APPLICATION

This application is a continuation-in-part of co-pending application Ser. No. 878,283 filed Apr. 29, 1986. The disclosure of Ser. No. 878,283 is incorporated by reference into the present application.

BACKGROUND OF THE INVENTION

1. Field of the Invention

This invention relates to a press apparatus for pressing a moving web formed on a forming wire. More particularly, this invention relates to a press apparatus including a first nip defined by cooperating press rolls and a second nip defined by an extended nip press with a second felt extending through both nips.

2. Information Disclosure Statement

In a press section of a papermaking machine, an important object is to remove as much water from the web as possible without damaging the formation, or crushing the web. It is a well-known fact that with every additional removal of even a fraction of a percent of water from the web, great savings in energy are accomplished. The water which is not removed in the press must be removed thermally in the dryer drum section of the paper machine, and the energy requirements for the removal of a unit of water by evaporation greatly exceed the energy requirements for removal of the same unit of water by pressing.

In U.S. Pat. No. 4,561,939 to E. J. Justus, assigned to Beloit Corporation, there is described a first dewatering nip defined by a pair of cooperating press rolls followed by an extended nip press. This patent discloses a pair of lower felts for transporting the formed web between the first and second nip. However, a suction roll, or the like, is required in order to transfer the formed web from the first lower felt to the second upper felt prior to the web being transported between the second upper felt and the second lower felt. The web, consequently, is not supported by either of the lower felts for a certain portion of the travel between the first and second nips. Also, during suction transfer from one felt to the next, water is transferred back into the sheet from the preceding felt.

The present invention provides means for supporting the web on a lower felt throughout the travel of the web between the first and second nip thereby providing a "no draw press" and eliminating the need for the transfer suction roll of the aforementioned second upper felt of the Justus patent.

Although U.S. Pat. No. 3,023,805 to Walker teaches a single lower felt extending between a first and a second nip, the second nip is not an extended nip press. Furthermore, in an alternative embodiment of the present invention, by the provision of a grooved blanket in the extended nip press, the need for a second upper felt is eliminated.

Therefore, it is a primary objective of the present invention to provide a press apparatus that overcomes the aforementioned inadequacies of the prior art proposals and which provides a press apparatus that contributes a significant improvement to the art of pressing a moving web that has been formed on a forming wire.

Another object of the present invention is the provision of a press apparatus having a first nip defined by a pair of cooperating press rolls and a second nip defined by an extended nip press, the web being supported between these nips by means of a felt which passes through both of these nips.

Another objective of the present invention is the provision of a press apparatus in which the second nip is defined by an extended nip press having a grooved blanket which eliminate the need for having a double felting of the extended nip press.

Another object of the present invention is the provision of a press apparatus in which the lower, second or tandem felt which extends through both the first and the second presses has a void volume which is greater than, and a surface texture that is smoother than the upper felt or felts such that the web tends to stay with the lower felt when the respective felts diverge relative to each other.

Other objects and advantages of the present invention will be apparent to those skilled in the art by a consideration of the following description including the claims taken together with the annexed drawings.

SUMMARY OF THE INVENTION

The present invention relates to a press apparatus and a method for pressing a moving web formed on a forming wire. The apparatus includes a frame and a first plurality of rolls rotatably secured to the frame. A first continuous felt extends around the first plurality of rolls which includes a first press roll. A second plurality of rolls is rotatably secured to the frame and a second continuous felt extends around the second plurality of rolls with the second felt cooperating with the first felt. The second plurality of rolls includes a second press roll which cooperates with the first press roll for defining therebetween a first nip such that when the web moves towards the first nip, the web is pressed between the first and second felts during passage through the first nip. The web is urged against the second felt when the pressed web emerges from the first nip such that the web is supported by the second felt when the first and second felts diverge relative to each other. An extended nip press means is disposed downstream relative to the first nip for imparting further dewatering to the web when the web supported by the second felt passes through a second nip defined by the extended nip press means.

In one embodiment of the present invention, the extended nip press includes a grooved blanket which eliminates the need for double-felting of the extended nip press because as the grooved blanket, the second felt, and the web supported thereon pass through the second nip, water removed from the web passes through the second felt into the grooves of the blanket.

In another embodiment of the present invention, the first press roll is a suction roll which serves additionally as a pickup roll thereby resulting in a compact press configuration.

In another embodiment of the present invention, the second press roll is a suction roll for urging the emerging web against the second felt.

In a further embodiment of the present invention, the extended nip press includes a third felt.

In a further embodiment of the present invention, the second, lower or tandem, felt has a higher void volume than the cooperating upper felt or felts. Furthermore, the surface texture of the lower felt is smoother than the texture of the upper felt or felts such that the web tends to stick to the lower felt when the lower felt diverges relative to the upper felt or felts.

The present invention includes many alternative arrangements and modifications which will be apparent to those skilled in the art. The present invention is not limited to the various embodiments described hereinafter which embodiments are merely illustrative of the present invention. Rather, the present invention is defined by the annexed claims which define the scope of the present invention.

BRIEF DESCRIPTION OF THE DRAWINGS

Similar reference numerals refer to similar parts throughout the various embodiments of the present invention.

DETAILED DESCRIPTION

Figure 1:
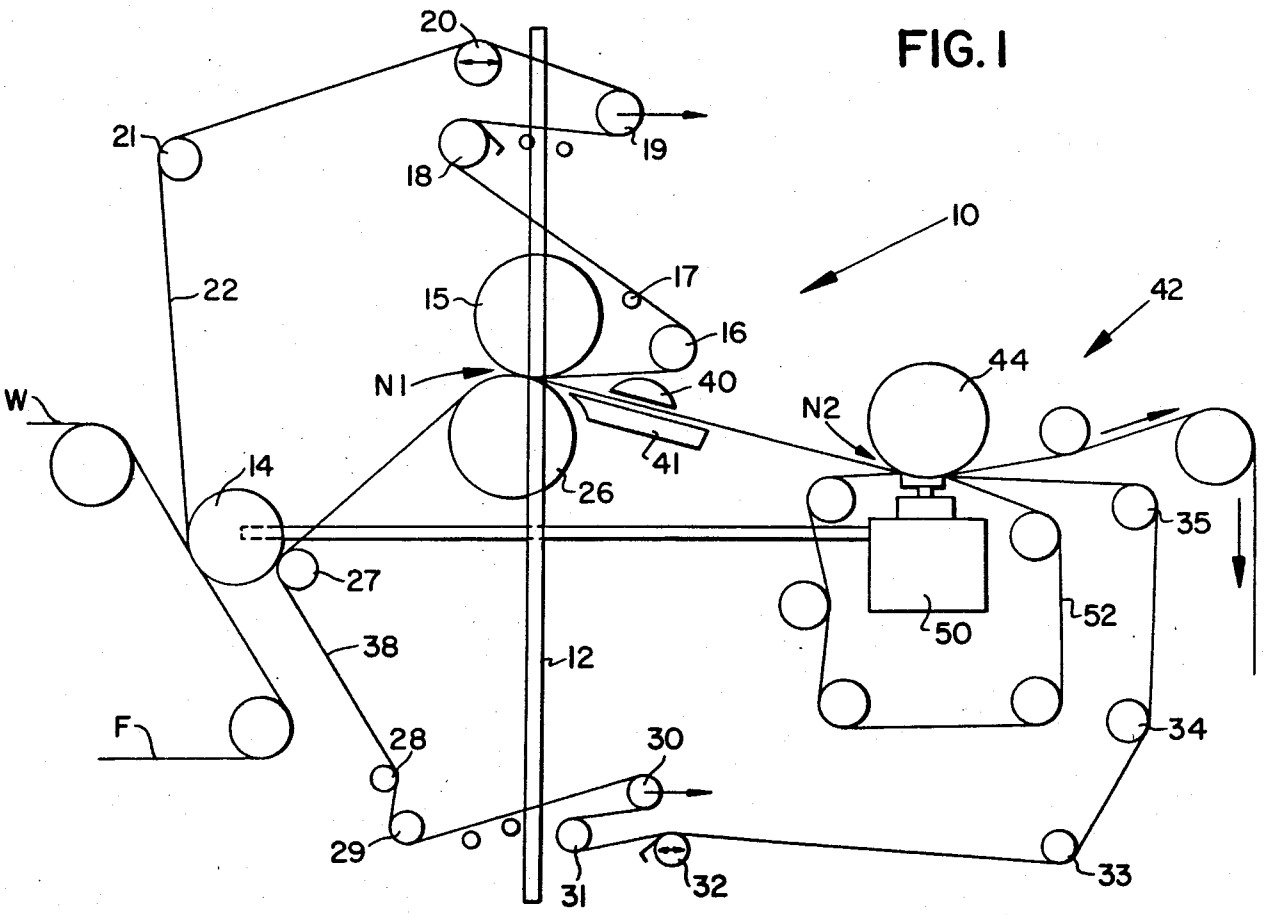
FIG. 1 is a side elevational view of a press apparatus according to the present invention with the extended nip press having no upper felt.

FIG. 1 shows a press apparatus generally designated 10 for pressing a moving web W formed on a forming wire F. The apparatus 10 includes a frame 12 and a first plurality of rolls 14,15,16,17,18,19,20 and 21. A first continuous felt 22 extends around the first plurality of rolls 14 to 21. The first plurality of rolls 14 to 21 includes a pickup roll 14 which may be a suction roll. The roll 14 is disposed adjacent to the wire F. The pickup roll 14 and the wire F cooperate together such that when the web W passes between the wire F and the pickup roll 14, the web W is transferred from the wire F onto the first felt 22. The roll 15 is a first press roll and is disposed downstream relative to the pickup roll 14. A second plurality of rolls 26,27,28,29,30,31,32,33,34 and 35 are rotatably secured to the frame 12. A second continuous felt 38 extends around the second plurality of rolls 26 to 35 with the second felt 38 cooperating with the first felt 22 such that the web W is supported by the first and second felts 22 and 38 respectively when the web W moves between the pickup roll 14 and the first press roll 15. The roll 26 is a second press roll which cooperates with the first press roll 15 for defining therebetween a first nip N1 such that when the web W moves from the pickup roll 14 and between the first and second felts 22 and 38 respectively towards the first nip N1, the web W is pressed between the first and second felts 22 and 38 respectively during passage through the first nip N1.

In the embodiment shown in FIG. 1, the first or second press rolls 15 and 26 may be grooved, suction or plain rolls or a combination thereof.

As shown in FIG. 1, a steam box 40 and suction shoe 41 are disposed on opposite sides of the second felt 38 and web downstream relative to the nip N1 for urging the web W against the second felt 38 when the web emerges from the first nip N1. This arrangement permits the web W to be supported by the second felt 38 when the first and second felts 22 and 38 diverge relative to each other. An extended nip press means generally designated 42 is disposed downstream relative to the first nip N1 for imparting to the web W a further dewatering when the web W supported by the second felt 38 passes through a second nip N2 defined by the extended nip press means 42. The extended nip press means 42 includes a plain roll 44, and a shoe 46 having a concave surface 48. Furthermore, the extended nip press includes means 50 for urging the shoe 46 against a grooved blanket 52 such that the second felt 38 is disposed between the blanket 52 and the web W during passage of the blanket, felt and web 52,38 and W respectively, through the nip N2. The blanket 52 is grooved on the surface disposed adjacent to the felt 38 as fully disclosed in copending International application No. PCT/US85/01953. All the disclosure of PCT/US85/01953 is incorporated herein by reference.

Figure 2:
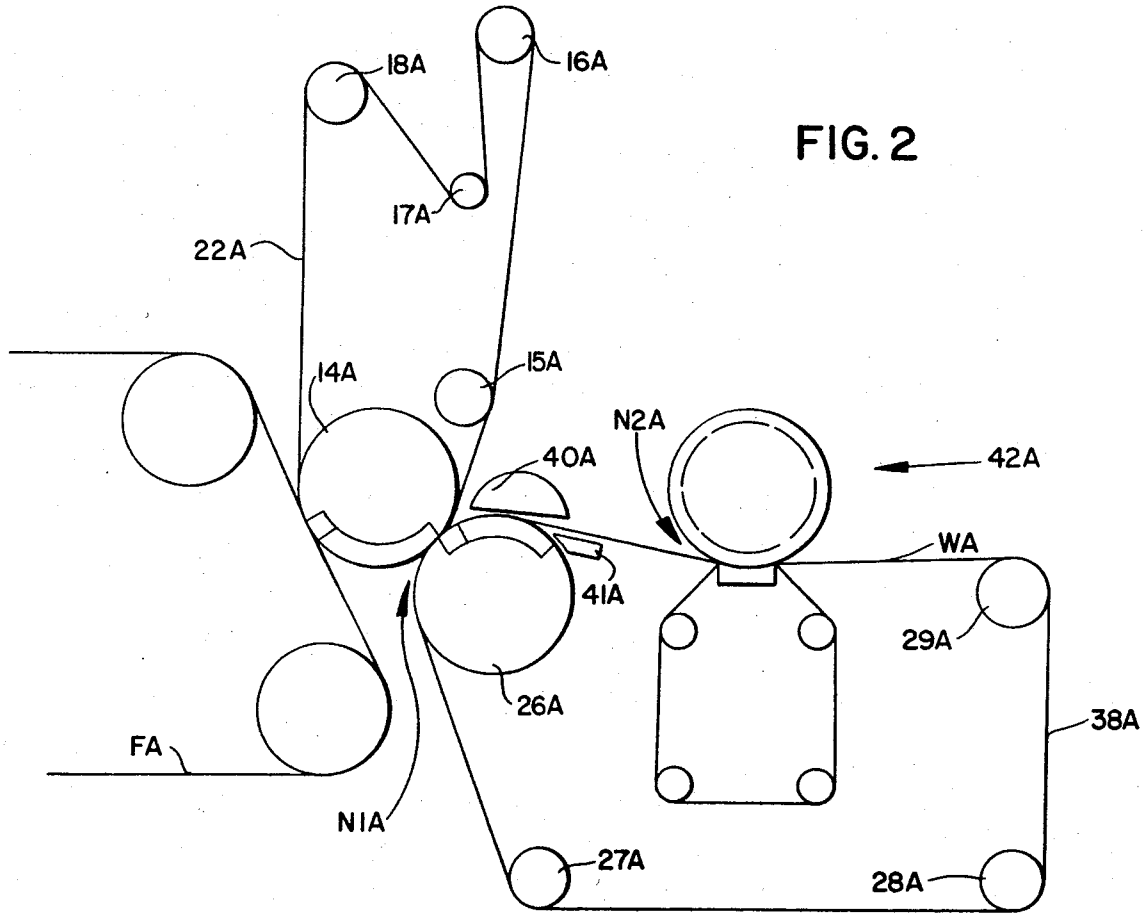
FIG. 2 is a side elevational view of an alternative embodiment of the present invention showing a compact press arrangement.

In an alternative embodiment of the present invention as shown in FIG. 2, a first felt 22A extends around a first plurality of rolls 14A,15A,16A,17A and 18A. A second felt 38A extends around a second plurality of rolls 26A,27A,28A and 29A. The first and second felts 22A and 38A cooperate together at a first nip N1A defined by cooperating first and second press rolls 14A and 26A respectively. As shown in FIG. 2, the web WA is transferred from the wire FA onto the first felt 22A by the roll 14A which may be a suction roll. The web WA supported by the first felt 22A is then contacted by the second felt 38A during passage of the web WA through the first nip N1A. The press arrangement of FIG. 2 provides a compact configuration and the web WA is supported by the second felt 38A during passage of the web WA through both the first nip N1A and a second nip N2A defined by an extended nip press means 42A. The arrangement shown in FIG. 2 also includes a steam box 40A and a vacuum shoe 41A disposed downstream relative to the first nip N1A for urging the web WA against the second felt 38A when the web WA emerges from the first nip N1A. Furthermore, the rolls 14A and 26A may be suction rolls having regions of high and low suction as shown in FIG. 2 for transferring the web WA from the wire FA to the felt 22A and for removing the optimal amount of water from the web WA during passage through the first nip N1A.

Figure 3:
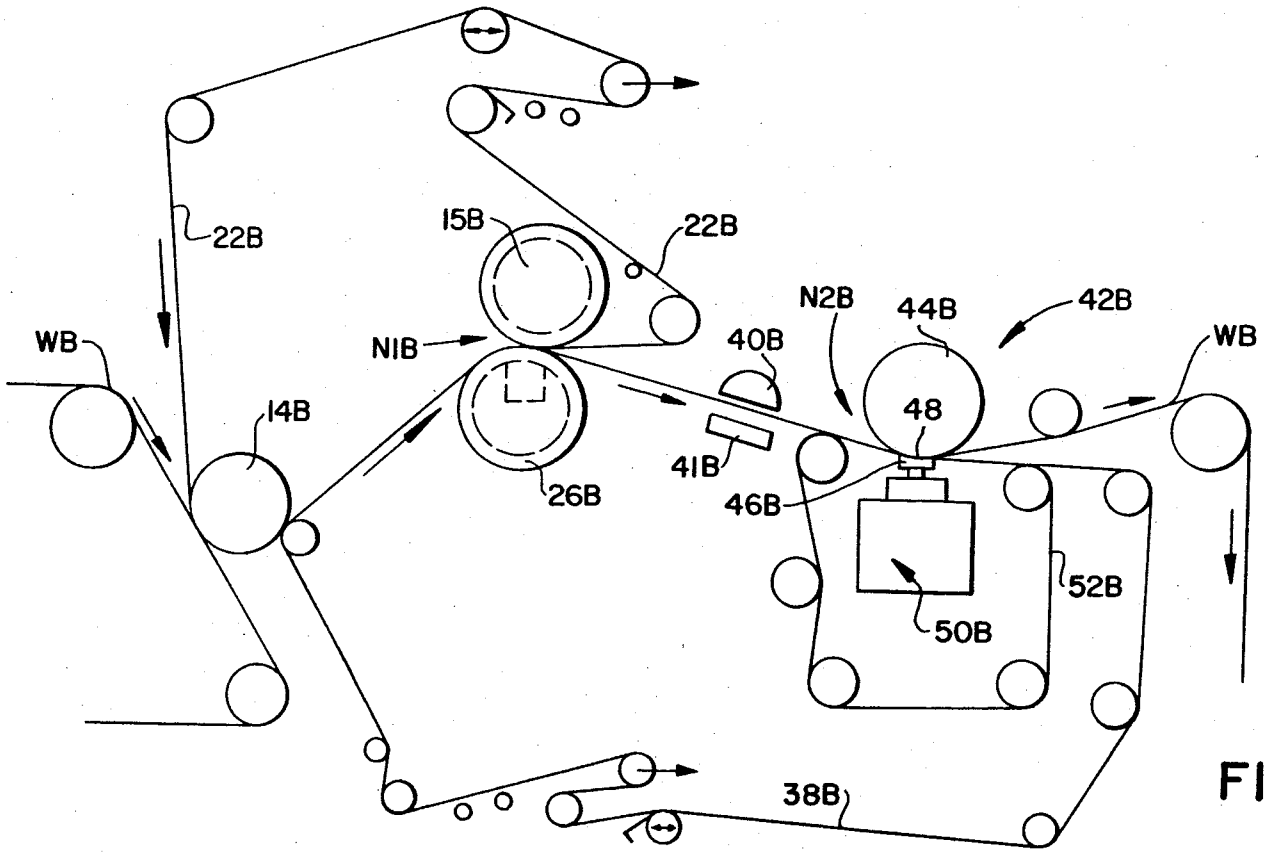
FIG. 3 is a side elevational view of another embodiment of the present invention showing the second press roll as a suction press roll.

FIG. 3 shows another alternative embodiment of the present invention in which the second press roll is replaced by a suction press roll 26B which urges the web WB emerging from the first nip N1B against the second felt 38B. In the embodiment shown in FIG. 3, because the roll 26B is a suction roll, the web WB will be urged against the second felt 38B when the felts 22B and 38B diverge relative to each other. Therefore, the steam box 40B and cooperating vacuum box 41B may be disposed nearer to the extended nip press means 42B than to the first nip N1B as the web WB will already be urged against the second felt 38B.

Figure 4:
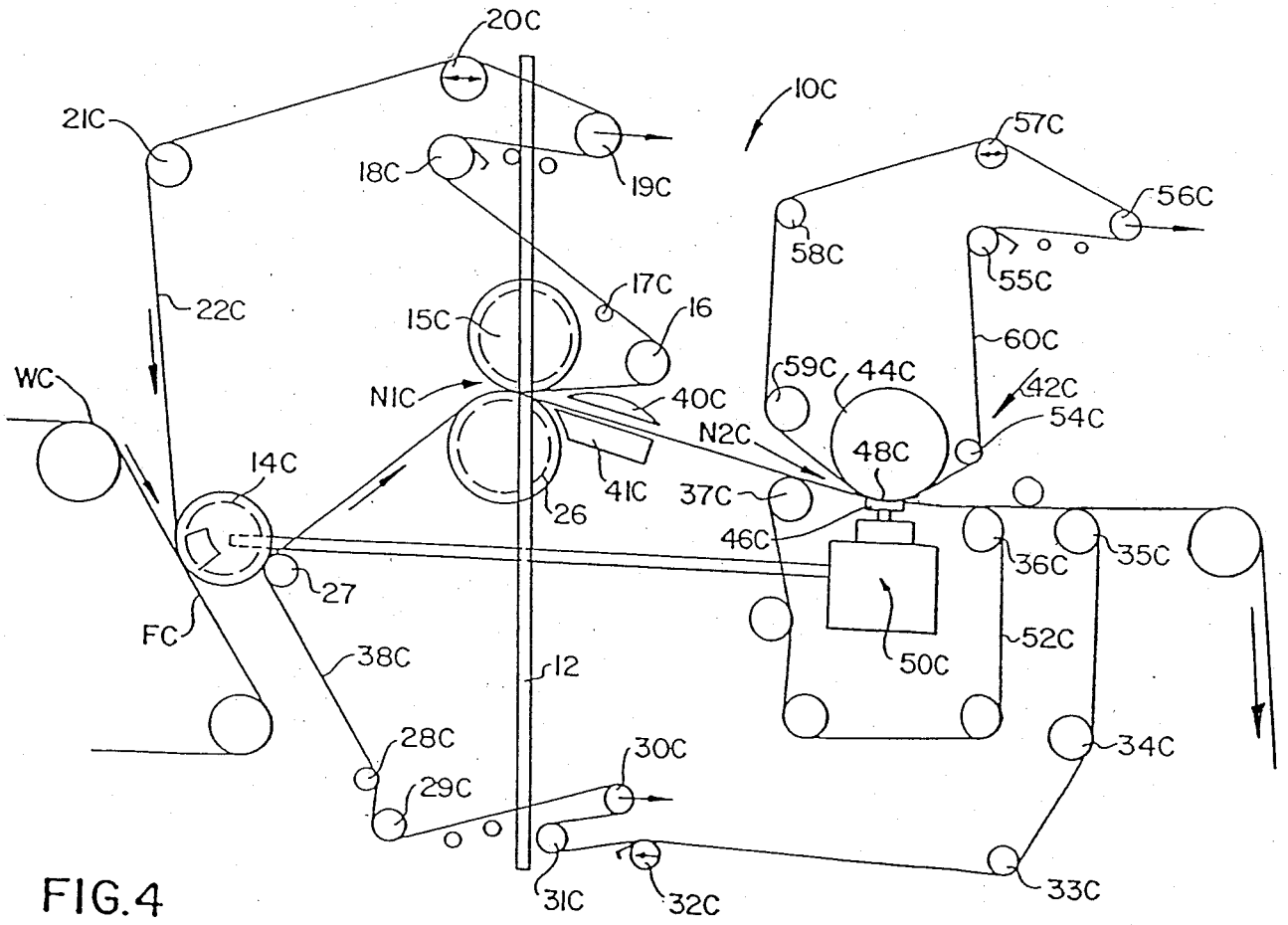
FIG. 4 is a side elevational view of yet another embodiment of the present invention in which the extended nip press means includes a third felt.

In the embodiment shown in FIG. 4, the extended nip press means 42C includes a third plurality of rolls 54C, 55C, 56C, 57C, 58C and 59C. A third felt 60C extends around the rolls 54C and 59C and around third press roll 44C such that the web WC is disposed between the second and third felts 38C and 60C respectively. Such a double-felted extended nip press means 42C is particularly advantageous when pressing heavy grade board which offers high flow resistance.

In operation of all four embodiments of the present invention, the formed web is transferred from the forming wire to a first felt by means of a pickup roll which may be a suction roll. The web is led towards a first nip which is defined by a first and second press roll such that a portion of the water within the web is removed from the web at the first nip. The first and second felts diverge relative to each other after emerging from the first nip and a steam box and cooperating vacuum shoe is used to urge the web emerging from the nip against the second felt.

More specifically, in the first embodiment, the steam box 40 and cooperating vacuum shoe 41 are disposed close to the first nip N1 so that the web is urged against the second felt 38.

The second embodiment operates such that the first press roll 14A not only serves as a pickup roll, but also as a press roll thereby providing a more compact press configuration and a reduction in components.

In operation of the third embodiment as shown in FIG. 3, the second press roll 26B is a suction roll, therefore the steam box 40B and vacuum box 41B are positioned further downstream nearer to the extended nip press means 42B. In all of the embodiments of FIGS. 1 through 3, the extended nip press means incorporates a grooved blanket thereby avoiding the necessity for a third felt.

In operation of the embodiment of FIG. 4, the extended nip press means 42C includes a third felt 60C so that a high flow resistant web may be pressed and adequately dewatered.

In a further embodiment of the present invention, the lower, second or tandem, felt 38, 38A, 38B and 38C has a void volume which is higher than the void volume of the corresponding upper felt or felts 22, 22A, 22B, 22C and 60C. Furthermore, the lower felt has a slightly smoother texture than the upper felts such that the web tends to follow the tandem lower felt rather than the upper felt when these felts diverge relative to each other.

The present invention greatly simplifies and reduces the cost of providing a dewatering press by eliminating the need for any transfer rolls for transferring the web between adjacent lower felts between the first and second nips. Also, the arrangement avoids the additional cost of providing two lower felts between the first and second nips. Additionally, the problem of rewetting during transfer of the web to a second lower felt is inhibited and difficulties experienced with the prior open draw arrangements are avoided. Furthermore, by utilizing a grooved blanket, the necessity for an upper felt for the extended nip press is eliminated.

Although, in the past, it may have appeared unviable to use a single lower felt for running through the first nip and then through an extended nip press because generally it was considered that such an arrangement would cause overloading of the lower felt, the foregoing arrangement has been found to operate extremely satisfactorily.

Other advantages and benefits to be derived from the foregoing arrangement will be readily apparent to those skilled in the art and the present invention encompasses many variations and modifications which fall within the spirit and scope of the present invention as defined by the appended claims.

What is claimed is:

1. A press apparatus for pressing a moving web formed on a forming wire, said apparatus comprising:

a frame;

a first plurality of rolls rotatably secured to said frame;

a first continuous felt extending around said first plurality of rolls;

said first plurality of rolls including:

a pickup roll disposed adjacent to the wire, said pickup roll and wire cooperating together such that when the web passes between the wire and the pickup roll, the web is transferred from the wire onto said first felt;

a first press roll disposed downstream relative to said pickup roll;

a second plurality of rolls rotatably secured to said frame;

a second continuous felt extending around said second plurality of rolls;

said second felt cooperating with said first felt such that the web is supported by and between said first and second felts when the web moves from said pickup roll to said first press roll;

said second plurality of rolls including:

a second press roll cooperating with said first press roll for defining therebetween, a first nip such that when the web moves from said pickup roll and between said first and second felts toward said first nip, the web is pressed between said first and second felts during passage through said first nip;

means for urging the web against said second felt when the pressed web emerges from said first nip such that the web is supported by said second felt when said first and second felts diverge relative to each other;

an extended nip press means disposed downstream relative to said first nip for imparting further dewatering to the web when the web supported by said second felt passes through a second nip defined by said extended nip press means;

said extended nip press means including:

a third press roll;

a shoe defining a concave surface such that said concave surface cooperates with said third press roll for defining therebetween said second nip;

means for urging said shoe towards said third press roll;

a continuous blanket extending through said second nip such that when said blanket, said second felt and the web pass through said second nip, said second felt is disposed between said blanket and the web;

a third plurality of rolls rotatably secured to said frame;

a third continuous felt extending around said third plurality of rolls, said third felt together with said blanket, said second felt and the web passing through said second nip such that the third felt is disposed between the web and said third press roll;

said blanket having a surface which is pressed against said second felt during passage of said blanket and second felt through said second nip, said surface defining a plurality of grooves for the reception therein of water removed from the web when the web passes through said second nip;

said second felt having a smoother texture than the texture of said third felt such that the web follows said second rather than said third felt when said second and third felts diverge relative to each other;

and said second felt has a void volume which is greater than the void volume of said third felt.

2. A press apparatus as set forth in claim 1 wherein said first press roll is a grooved roll.

3. A press apparatus as set forth in claim 1 wherein said first press roll is a plain roll.

4. A press apparatus as set forth in claim 1 wherein said second press roll is a grooved roll.

5. A press apparatus as set forth in claim 4 wherein said means for urging the web against said second felt is a steam box and cooperating suction shoe disposed downstream relative to said first nip such that when the web emerges from said first nip, the web is urged by said steam box and said suction shoe toward said second felt and away from said first felt.

6. A press apparatus as set forth in claim 1 wherein said means for urging the web against said second felt includes:

suction means disposed within said second press roll for applying suction through said second felt when the web is passing through said first nip for urging the web toward said second felt when the web emerges from said first nip.

7. A press apparatus as set forth in claim 1 wherein said third press roll is vented.

* * * * *